US009262963B2

(12) United States Patent
Toyomura

(10) Patent No.: US 9,262,963 B2
(45) Date of Patent: Feb. 16, 2016

(54) DISPLAY UNIT AND ELECTRONIC APPARATUS

(71) Applicant: Sony Corporation, Tokyo (JP)

(72) Inventor: Naobumi Toyomura, Kanagawa (JP)

(73) Assignee: JOLED Inc., Tokyo (JP)

( * ) Notice: Subject to any disclaimer, the term of this patent is extended or adjusted under 35 U.S.C. 154(b) by 0 days.

(21) Appl. No.: 14/508,639

(22) Filed: Oct. 7, 2014

(65) Prior Publication Data

US 2015/0123558 A1 May 7, 2015

(30) Foreign Application Priority Data

Nov. 7, 2013 (JP) ..... 2013-231213

(51) Int. Cl.
*G09G 3/30* (2006.01)
*G09G 3/32* (2006.01)

(52) U.S. Cl.
CPC ..... *G09G 3/3233* (2013.01); *G09G 2300/0852* (2013.01); *G09G 2320/0219* (2013.01); *G09G 2320/0233* (2013.01); *G09G 2320/043* (2013.01)

(58) Field of Classification Search
CPC . G09G 3/3258; G09G 3/3233; G09G 3/3208; G09G 2320/0219; G09G 2320/043; G09G 2320/0233; G11C 19/184; G11C 19/28; H05B 33/08; H05B 41/42
USPC ..... 345/76–79, 82, 90, 92, 204, 211, 212; 315/169.1–169.3, 240
See application file for complete search history.

(56) References Cited

U.S. PATENT DOCUMENTS 7,760,167 B2 * 7/2010 Uchino ..... G09G 3/3233 315/169.1
8,284,182 B2 * 10/2012 Yamamoto ..... G09G 3/3266 326/112
8,477,092 B2 * 7/2013 Neugebauer ..... G02F 1/13624 345/98

FOREIGN PATENT DOCUMENTS

JP 2008-083272 4/2008

* cited by examiner

*Primary Examiner* — Haissa Philogene
(74) *Attorney, Agent, or Firm* — Michael Best & Friedrich LLP

(57) ABSTRACT

A display unit provided with a display panel including a light emitting element and a pixel circuit for each pixel, and a drive circuit configured to drive each of the pixels. The pixel circuit includes: a first transistor configured to sample a voltage corresponding to a picture signal, the first transistor having characteristics that a parasitic capacitance at a time when the first transistor is turned off is decreased as magnitude of negative bias applied to a gate voltage is increased; a second transistor configured to control a current flowing through the light emitting element based on magnitude of the voltage sampled by the first transistor; and a retention capacitance configured to retain the voltage sampled by the first transistor.

7 Claims, 9 Drawing Sheets

$$Gbst = \Delta Vg / \Delta Vs = (Cs+Cgs)/(Cs+Cgs+Cws+Cgd)$$

$$Vgs = Vth + Vsig - Vloss$$

$$Vloss = \{Vel - (Vofs - Vth)\} \times (1 - Gbst)$$

$$Gbst = \Delta Vg / \Delta Vs$$
$$= (Cs+Cgs)/(Cs+Cgs+Cws+Cgd)$$
$$Vgs = Vth + Vsig - Vloss$$
$$Vloss = \{Vel - (Vofs - Vth)\} \times (1 - Gbst)$$

DISPLAY UNIT AND ELECTRONIC APPARATUS

CROSS REFERENCE TO RELATED APPLICATIONS

This application claims the benefit of Japanese Priority Patent Application JP 2013-231213 filed Nov. 7, 2013, the entire contents of which are incorporated herein by reference.

BACKGROUND

The present disclosure relates to a display unit and an electronic apparatus including the display unit.

In recent years, in a field of display units performing picture display, a display unit using, as a light emitting element of a pixel, a current drive type optical element whose light emission luminance is varied in response to a value of a flowing current, for example, an organic electro luminescence (EL) element, has been developed and commercialization thereof is progressing. Unlike a liquid crystal element, the organic EL element is a self light emitting element. Therefore, since a light source (a backlight) is unnecessary in the display unit using the organic EL element (an organic EL display unit), the display unit is allowed to be reduced in weight, in thickness, and improved in luminance, as compared with a liquid crystal display unit demanding a light source. Further, since a response speed of the organic EL element is about several μs, which is extremely high, an after image during moving picture display does not occur. Accordingly, the organic EL display unit is expected to be a mainstream of next generation flat panel display.

In the organic EL display unit, the drive method thereof includes a simple (passive) matrix method and an active matrix method, as with the liquid crystal display unit. The former has a simple configuration; however, has a difficulty to achieve a large display unit with high definition. Therefore, development of the active matrix method has been actively carried out. In this method, a current flowing through an organic EL element arranged for each pixel is controlled by a drive transistor in a pixel circuit that is provided for each organic EL element.

In the active matrix organic EL display unit, the scan lines are sequentially scanned and a signal voltage corresponding to a picture signal is sampled and written to a retention capacitance, in every horizontal period (1H). In other words, writing operation of the signal voltage is performed by linear sequential scanning of 1H period. Moreover, in the organic EL display unit, when a threshold voltage and a mobility of the drive transistor are varied for each pixel, light emission luminance of organic EL element is varied and uniformity of a screen is impaired. Therefore, in the active matrix organic EL display unit, correction operation to reduce variation of light emission luminance caused by variation of the threshold voltage and the mobility of the drive transistor is performed together with the linear sequential scanning of 1H period (refer to Japanese Unexamined Patent Application Publication No. 2008-083272).

SUMMARY

Incidentally, when the writing operation of the signal voltage is performed, a source voltage of the drive transistor rises to a light emission voltage of the organic EL element. A gate voltage of the drive transistor also rises due to coupling of a retention capacitance in association with variation of the source voltage. A ratio of rising of the gate voltage to rising of the source voltage is called bootstrap gain. The bootstrap gain may be lowered due to a parasitic capacitance of the transistor in a pixel circuit. The parasitic capacitance of the transistor in the pixel circuit has a threshold voltage of the transistor as a parameter. Therefore, the bootstrap gain may be varied for each pixel due to variation of the threshold voltage of the transistor in the pixel circuit. In this case, light emission luminance is varied for each pixel, and uniformity of a screen is impaired.

It is desirable to provide a display unit capable of reducing variation of bootstrap gain for each pixel, and an electronic apparatus including the display unit.

According to an embodiment of the technology, there is provided a display unit provided with a display panel including a light emitting element and a pixel circuit for each pixel, and a drive circuit configured to drive each of the pixels. The pixel circuit includes: a first transistor configured to sample a voltage corresponding to a picture signal, the first transistor having characteristics that a parasitic capacitance at a time when the first transistor is turned off is decreased as magnitude of negative bias applied to a gate voltage is increased; a second transistor configured to control a current flowing through the light emitting element based on magnitude of the voltage sampled by the first transistor; and a retention capacitance configured to retain the voltage sampled by the first transistor.

According to an embodiment of the technology, there is provided an electronic apparatus provided with a display unit. The display unit includes a display panel that includes a light emitting element and a pixel circuit for each pixel, and a drive circuit configured to drive each of the pixels. The pixel circuit includes: a first transistor configured to sample a voltage corresponding to a picture signal, the first transistor having characteristics that a parasitic capacitance at a time when the first transistor is turned off is decreased as magnitude of negative bias applied to a gate voltage is increased; a second transistor configured to control a current flowing through the light emitting element based on magnitude of the voltage sampled by the first transistor; and a retention capacitance configured to retain the voltage sampled by the first transistor.

In the display unit and the electronic apparatus according to the respective embodiments of the technology, the first transistor sampling the voltage corresponding to the picture signal has the characteristics that the parasitic capacitance at a time when the first transistor is turned off is decreased as the magnitude of the negative bias applied to the gate voltage is increased. Accordingly, for example, when the light emitting element is allowed to emit light, the voltage having the negative value allowing the first transistor to be turned off is applied to the gate of the first transistor, which results in reduction in the parasitic capacitance of the first transistor at the time of bootstrap.

According to the display unit and the electronic apparatus according to the respective embodiments of the technology, the parasitic capacitance of the first transistor at the time of bootstrap is allowed to be made small. Therefore, it is possible to reduce variation of the bootstrap gain for each pixel.

It is to be understood that both the foregoing general description and the following detailed description are exemplary, and are intended to provide further explanation of the technology as claimed.

BRIEF DESCRIPTION OF THE DRAWINGS

The accompanying drawings are included to provide a further understanding of the disclosure, and are incorporated in and constitute a part of this specification. The drawings illustrate embodiments and, together with the specification, serve to explain the principles of the technology.

FIG. 7 is a waveform diagram illustrating an example of temporal change of voltages applied to a scan line WSL, a power line DSL, and a signal line DTL, a gate voltage, and a source voltage, when one pixel is focused on.

DETAILED DESCRIPTION

Hereinafter, an embodiment of the technology will be described in detail with reference to drawings. Note that description thereof will be given in the following order.

1. Embodiment (Display Unit)
2. Application Examples (Electronic Apparatuses)

1. EMBODIMENT

Configuration

Figure 1:
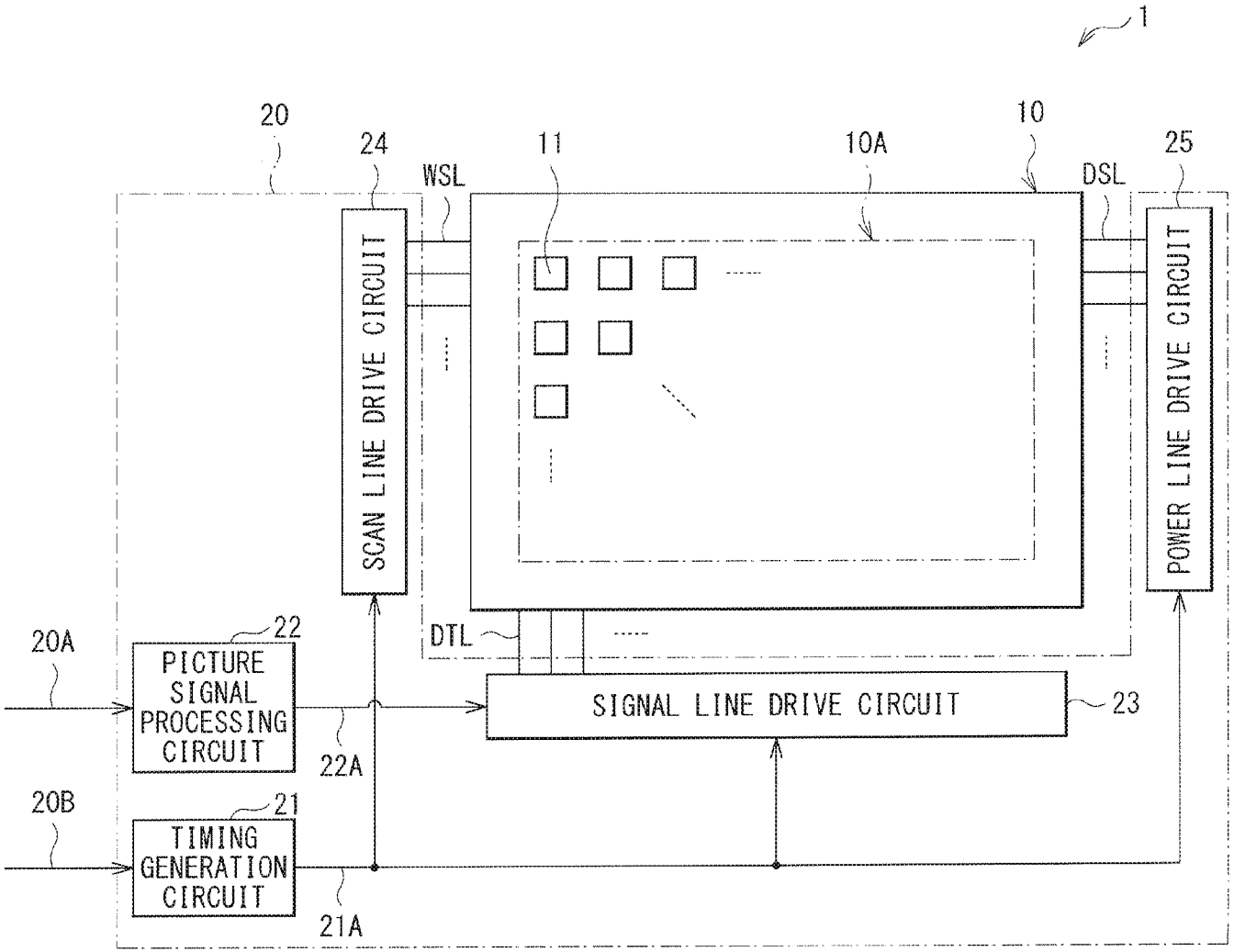
FIG. 1 is a schematic configuration diagram of a display unit according to an embodiment of the technology.

FIG. 1 illustrates a schematic configuration of a display unit 1 according to an embodiment of the technology. The display unit 1 includes a display panel 10 and a drive circuit 20 driving the display panel 10 based on a picture signal 20A and a synchronization signal 20B that are input from outside. For example, the drive circuit 20 may include a timing generation circuit 21, a picture signal processing circuit 22, a signal line drive circuit 23, a scan line drive circuit 24, and a power line drive circuit 25.

(Display Panel 10)

The display panel 10 is configured of a plurality of pixels 11 that are arranged in a matrix over an entire display region 10A of the display panel 10. When the pixels 11 are driven by an active matrix driving method by the drive circuit 20, the display panel 10 displays an image based on the picture signal 20A input from the outside.

Figure 2:
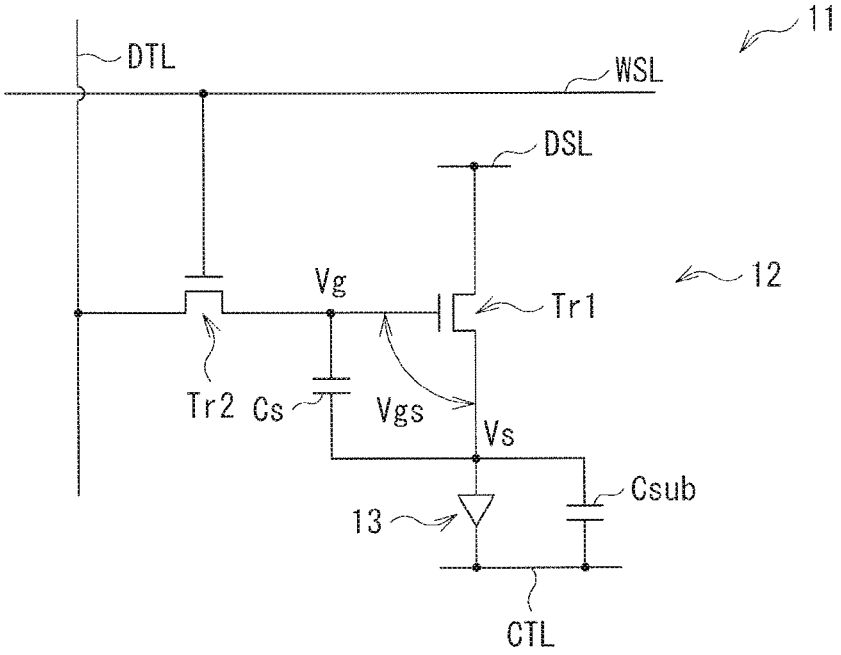
FIG. 2 is a diagram illustrating an example of a circuit configuration of each pixel.

FIG. 2 illustrates an example of a circuit configuration of the pixel 11. Each of the pixels 11 may have, for example, a pixel circuit 12 and an organic EL element 13. For example, the organic EL element 13 may have a configuration in which an anode electrode, an organic layer, and a cathode electrode are stacked in order. The organic EL element 13 has an element capacitance Coled (not illustrated). The pixel circuit 12 controls light emission and light extinction of the organic EL element 13. The pixel circuit 12 has a function of retaining a voltage written into each of the pixels 11 by write scanning described later. For example, the pixel circuit 12 may be configured of a drive transistor Tr1, a write transistor Tr2, a retention capacitance Cs, and a sub-capacitance Csub, and has a circuit configuration of 2Tr2C.

The write transistor Tr2 controls application of a signal voltage to a gate of the drive transistor Tr1. The signal voltage corresponds to the picture signal. Specifically, the write transistor Tr2 samples a voltage of a signal line DTL described later, and writes the voltage of the signal line DTL to the gate of the drive transistor Tr1. The drive transistor Tr1 drives the organic EL element 13, and is connected in series to the organic EL element 13. The drive transistor Tr1 controls a current flowing through the organic EL element 13 depending on magnitude of the voltage written by the write transistor Tr2. The retention capacitance Cs retains a predetermined voltage between the gate and a source of the drive transistor Tr1. The sub-capacitance Csub supplies a part of a current supplied from the drive transistor Tr1. Note that the pixel circuit 12 may have a circuit configuration in which various capacitances and transistors are added to the above-described circuit configuration of 2Tr2C, or may have a circuit configuration different from the above-described circuit configuration of 2Tr2C.

Each of the drive transistor Tr1 and the write transistor Tr2 may be formed of, for example, an n-channel MOS thin film transistor (TFT). Note that these transistors may be each formed of a p-channel MOS TFT. These transistors may be of an enhancement type or a depression type.

Figure 3:
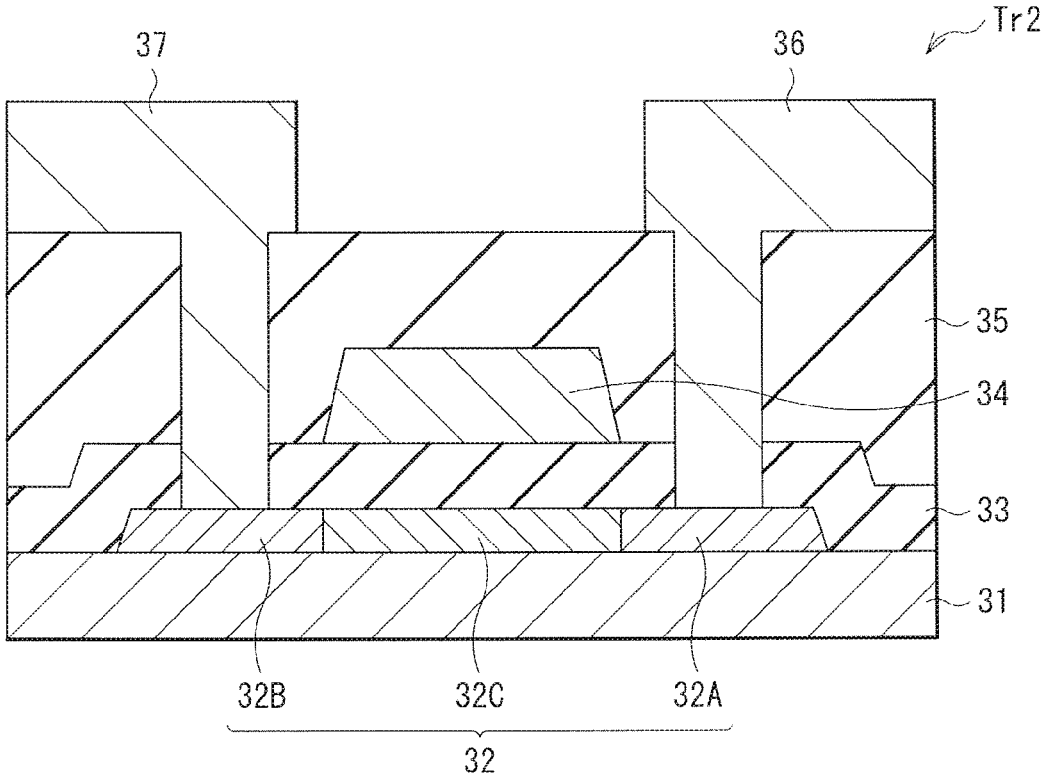
FIG. 3 is a diagram illustrating an example of a sectional surface structure of a write transistor.

FIG. 3 illustrates an example of a sectional surface structure of the write transistor Tr2. For example, the write transistor Tr2 may have an oxide semiconductor layer 32, a gate insulating film 33, a gate electrode 34, and an interlayer insulating film 35 in this order on a substrate 31. The oxide semiconductor layer 32 has a low-resistance source region 32A and a low-resistance drain region 32B at positions sandwiching a part directly below the gate electrode 34. The oxide semiconductor layer 32 also has a channel region 32C higher in resistance than the source region 32A and the drain region 32B, at a position directly below the gate electrode 34. For example, the write transistor Tr2 may further have a source electrode 36 electrically connected to the source region 32A through an opening that is formed directly above the source region 32A in the interlayer insulating film 35. For example, the write transistor Tr2 may further have a drain electrode 37 electrically connected to the drain region 32B through an opening that is formed directly above the drain region 32B in the interlayer insulating film 35.

Figure 4:
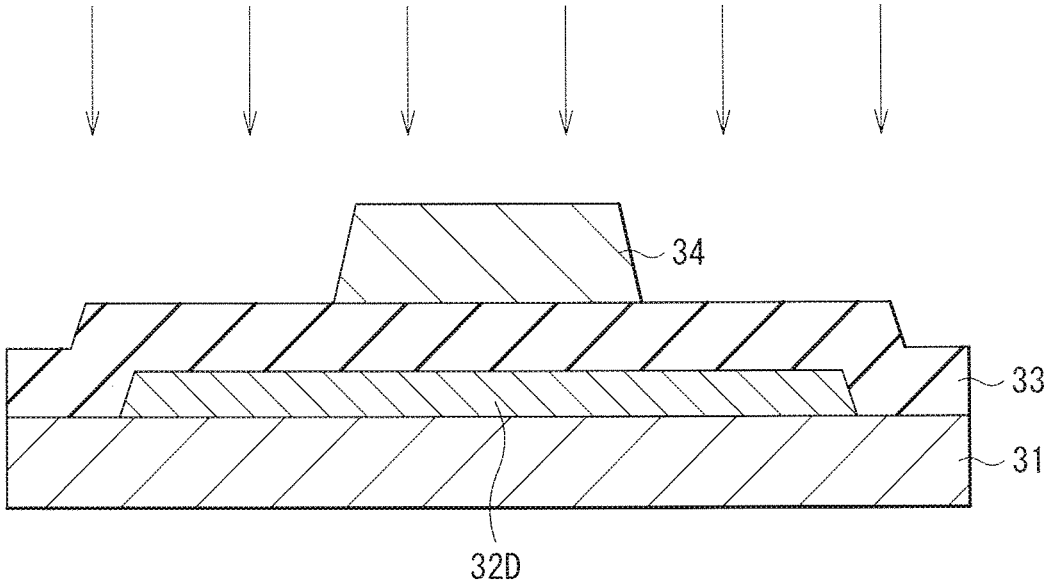
FIG. 4 is a diagram illustrating an example of a method of forming a source region and a drain region.

For example, the substrate 31 may be a glass substrate. For example, the oxide semiconductor layer 32 may contain In, Ga, Zn, and O as constituent atoms. For example, as illustrated in FIG. 4, the source region 32A and the drain region 32B may be formed by performing Al doping on the oxide semiconductor layer 32D that contains In, Ga, Zn, and O as constituent atoms, with use of the gate electrode 34 as a mask. Incidentally, the source region 32A and the drain region 32B may be formed by performing other treatments on the oxide semiconductor layer 32D. For example, the gate insulating film 33 may be formed of inorganic material such as SiOx and SiNx. For example, the gate electrode 34 may be formed of a metal material such as Ti, Al, and Cu. For example, the interlayer insulating film 35 may be formed by curing a photosensitive resin.

Figure 5:
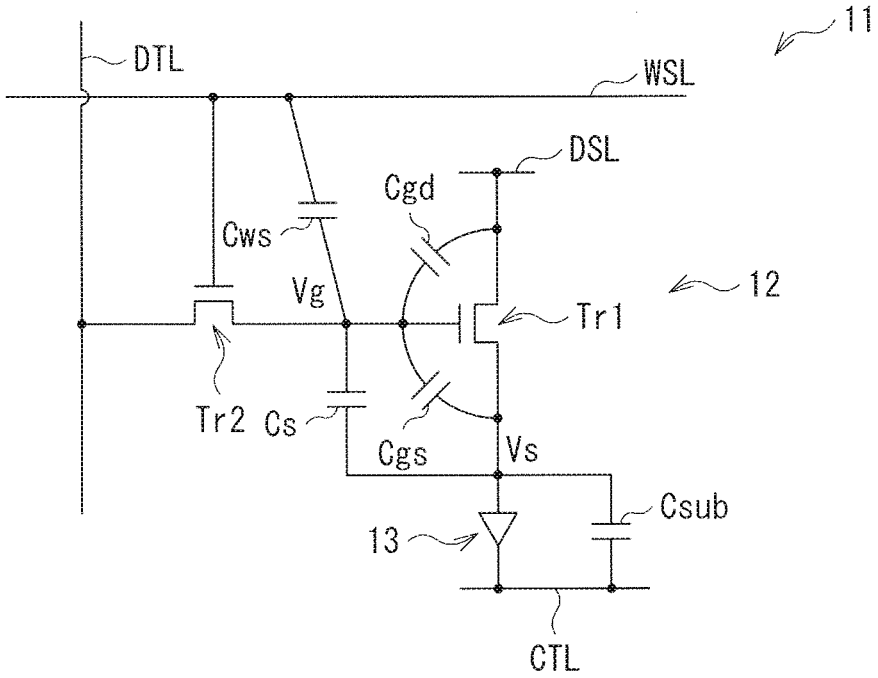
FIG. 5 is a diagram illustrating an example of a parasitic capacitance in a pixel circuit.

FIG. 5 illustrates an example of a parasitic capacitance in the pixel circuit 12. In the pixel circuit 12, a gate-source capacitance Cws of the write transistor Tr2 exists when the write transistor Tr2 is turned off. Moreover, in the pixel circuit 12, a gate-source capacitance Cgs of the drive transistor Tr1 exists when the drive transistor Tr1 is turned off. Further, in the pixel circuit 12, a gate-source capacitance Cgd of the drive transistor Tr1 exists. Therefore, in the pixel circuit 12, the gate-source capacitance Cws, the gate-source capacitance Cgs, and the gate-drain capacitance Cgd mainly exist at the time of bootstrap described later.

A ratio of rising of the gate voltage Vg to rising of the source voltage Vs at the time of bootstrap is called bootstrap gain. The bootstrap gain is represented by the following expression (1).

$$Gbst = \Delta Vg / \Delta Vs \quad (1)$$

$$= (Cs + Cgs)/(Cs + Cgs + Cws + Cgd)$$

Here, Gbst indicates the bootstrap gain. Cs indicates a retention capacitance of the pixel circuit 12. Cgs indicates the gate-source capacitance of the drive transistor Tr1. Cws indicates the gate-source capacitance of the write transistor Tr2. Cgd indicates the gate-drain capacitance of the drive transistor Tr1.

When the bootstrap gain Gbst is 100%, the gate-source voltage Vgs of the drive transistor Tr1 that is corrected through Vth correction and μ correction described later is not varied by the bootstrap. However, when the bootstrap gain Gbst is lower than 100%, the gate-source voltage Vgs of the drive transistor Tr1 after the bootstrap is represented by the following expression (2). Vloss in the expression (2) is represented by the following expression (3) and includes the threshold voltage Vth. In other words, the gate-source voltage Vgs of the drive transistor Tr1 after the bootstrap may be varied for each pixel 11 due to variation of the threshold voltage Vth of the drive transistor Tr1. Note that Vel indicates a threshold voltage of the organic EL element 13.

$$Vgs = Vth + Vsig - Vloss \quad (2)$$

$$Vloss = [Vel - (Vofs - Vth)] \times (1 - Gbst) \quad (3)$$

In the present embodiment, for example, a top-gate type transistor including the above-described oxide semiconductor layer 32 may be used as the write transistor Tr2 in order to suppress such variation.

Figure 6:
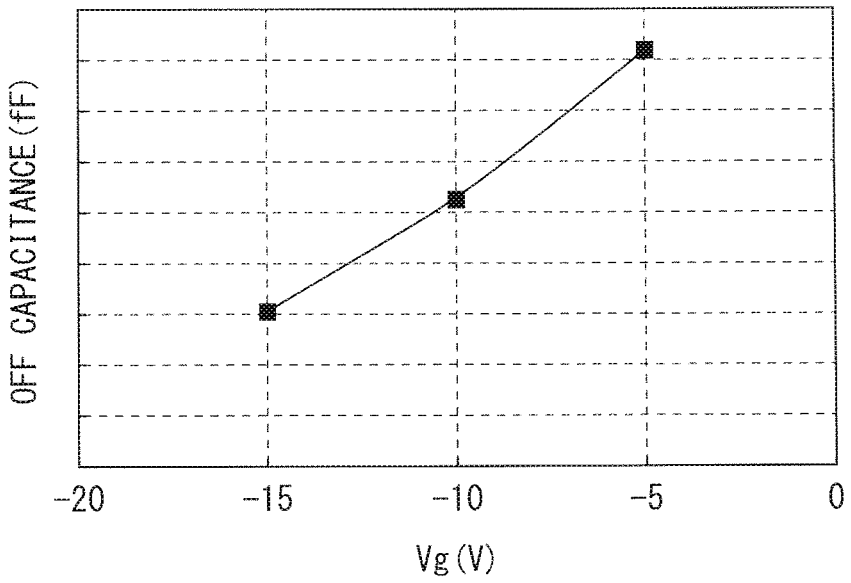
FIG. 6 is a diagram illustrating an example of gate voltage dependency of an off capacitance of the write transistor.

FIG. 6 illustrates an example of gate voltage dependency of an off capacitance of the write transistor Tr2 (specifically, a parasitic capacitance when the write transistor Tr2 is turned off) in the case where the write transistor Tr2 is configured of a top-gate type transistor including the oxide semiconductor layer 32. It is found from FIG. 6 that the write transistor Tr2 has characteristics that the off capacitance is decreased as magnitude of negative bias applied to the gate voltage is increased. Note that the write transistor Tr2 may be configured of a transistor having a configuration different from that described above as long as the transistor has characteristics that the off capacitance is decreased as the magnitude of the negative bias applied to the gate voltage is increased.

The display panel 10 has a plurality of scan lines WSL each extending in a row direction, a plurality of signal lines DTL each extending in a column direction, a plurality of power lines DSL each extending in the row direction, and a plurality of cathode lines CTL each extending in the row direction. Incidentally, the cathode lines CTL may be formed of one common sheet metal layer. The scan lines WSL are used to select the respective pixels 11. The signal lines DTL are used to supply the signal voltage corresponding to the picture signal, to the respective pixels 11. The power lines DSL are used to supply a drive current to the respective pixels 11.

The pixel 11 is provided near an intersection between each of the signal lines DTL and each of the scan lines WSL. Each of the signal lines DTL is connected to an output end (not illustrated) of the signal line drive circuit 23 described later and to a source or a drain of the write transistor Tr2. Each of the scan lines WSL is connected to an output end (not illustrated) of the scan line drive circuit 24 described later and to a gate of the write transistor Tr2. Each of the power lines DSL is connected to an output end (not illustrated) of a power source outputting a fixed voltage and to a source or a drain of the drive transistor Tr1. For example, the cathode lines CTL may be connected to members that are provided around the display region 10A and have a reference voltage.

The gate of the write transistor Tr2 is connected to the scan line WSL. The source or the drain of the write transistor Tr2 is connected to the signal line DTL. A terminal not connected to the signal line DTL out of the source and the drain of the write transistor Tr2 is connected to the gate of the drive transistor Tr1. The source or the drain of the drive transistor Tr1 is connected to the power line DSL. A terminal not connected to the power line DSL out of the source and the drain of the drive transistor Tr1 is connected to an anode of the organic EL element 13. A first end of the retention capacitance Cs is connected to the gate of the drive transistor Tr1. A second end of the retention capacitance Cs is connected to the source (a terminal on the organic EL element 13 side in FIG. 2) of the drive transistor Tr1. In other words, the retention capacitance Cs is interposed between the gate and the source of the drive transistor Tr1. A first end of the sub-capacitance Csub is connected to the source (the terminal on the organic EL element 13 side in FIG. 2) of the drive transistor Tr1. A second end of the sub-capacitance Csub is connected to the cathode line CTL.

(Drive Circuit 20)

Next, the drive circuit 20 is described. As described above, for example, the drive circuit 20 may include the timing generation circuit 21, the picture signal processing circuit 22, the signal line drive circuit 23, the scan line drive circuit 24, and the power line drive circuit 25. The timing generation circuit 21 controls the circuits in the drive circuit 20 to operate in conjunction with one another. For example, the timing generation circuit 21 may output a control signal 21A to the above-described respective circuits in response to (in synchronization with) the synchronization signal 20B input from the outside.

For example, the picture signal processing circuit 22 may perform predetermined correction on the digital picture signal 20A input from the outside, and outputs a picture signal 22A thus obtained to the signal line drive circuit 23. Examples of the predetermined correction may include, for example, gamma correction and overdrive correction.

For example, the signal line drive circuit 23 may apply an analog signal voltage to the respective signal lines DTL in response to (in synchronization with) the input of the control signal 21A. The analog signal voltage corresponds to the picture signal 22A input from the picture signal processing circuit 22. For example, the signal line drive circuit 23 is capable of outputting two kinds of voltages (Vofs and Vsig). Specifically, the signal line drive circuit 23 supplies the two kinds of voltages (Vofs and Vsig) to the pixel 11 that is selected by the scan line drive circuit 24, through the signal line DTL. The voltage Vsig has a voltage value corresponding to the picture signal 20A. The voltage Vofs is a constant voltage not relating to the picture signal 20A. A minimum voltage of the voltage Vsig is lower than the voltage Vofs, and a maximum voltage of the voltage Vsig is higher than the voltage Vofs.

For example, the scan line drive circuit 24 may select the plurality of scan lines WSL by a predetermined sequence in response to (in synchronization with) the input of the control signal 21A to perform Vth correction, writing of the signal voltage Vsig, μ correction, and Gbst adjustment in a desired order. In this case, the Vth correction indicates correction operation of making the gate-source voltage Vgs of the drive transistor Tr1 close to the threshold voltage of the drive transistor Tr1. The writing of the signal voltage Vsig (the signal writing) indicates operation of writing the signal voltage Vsig to the gate of the drive transistor Tr1 through the write transistor Tr2. The μ correction indicates operation of correcting the voltage retained between the gate and the source of the drive transistor Tr1 (the gate-source voltage Vgs) based on the magnitude of a mobility μ of the drive transistor Tr1. The signal writing and the μ correction are performed at timings different from each other in some cases. In the present embodiment, the scan line drive circuit 24 outputs one selection pulse to the scan line WSL to perform the signal writing and the μ correction at the same time (or successively with no pause). The Gbst adjustment indicates suppression of lowering of the bootstrap gain.

For example, the scan line drive circuit 24 is capable of outputting three kinds of voltages (Von, Voff1, and Voff2). Specifically, the scan line drive circuit 24 supplies the three kinds of voltages (Von, Voff1, and Voff2) to the pixel 11 to be driven, through the scan line WSL, to perform on-off control of the write transistor Tr2 and the Gbst adjustment. Here, the voltage Von has a value equal to or larger than an on voltage of the write transistor Tr2. The voltage Von is equivalent to a crest value of a write pulse that is output from the scan line drive circuit 24 during "latter half of Vth correction preparation period", "Vth correction period", "signal writing-μ correction period", and the like that will be described later. The voltage Voff1 has a value lower than the on voltage of the write transistor Tr2, and is lower than the voltage Von. The voltage Voff1 is equivalent to a crest value of the write pulse that is output from the scan line drive circuit 24 during "first half of Vth correction preparation period", "Vth correction suspension period", "part of light emission period (for example, latter half)", and the like that will be described later. The voltage Voff2 has a negative value lower than the voltage Voff1. The voltage Voff2 is equivalent to a crest value of the write pulse that is output from the scan line drive circuit 24 during "Gbst adjustment period" described later.

Note that the voltage Voff2 corresponds to a specific example of "first voltage having a negative value allowing a first transistor to be turned off when a light emitting element is allowed to emit light" in the present technology. The voltage Voff1 corresponds to a specific example of "second voltage applied to a gate of a first transistor to turn off the first transistor during non-light emission of a light emitting element" and "third voltage" in the present technology. The drive transistor Tr1 corresponds to a specific example of "second transistor" in the present technology. The write transistor Tr2 corresponds to a specific example of "first transistor" in the present technology.

For example, the power line drive circuit 25 may sequentially select the plurality of power lines DSL for a predetermined unit in response to (in synchronization with) the input of the control signal 21A. For example, the power line drive circuit 25 is capable of outputting two kinds of voltages (Vcc and Vss). The power line drive circuit 25 supplies the two kinds of voltages (Vcc and Vss) to the pixel 11 selected by the scan line drive circuit 24, through the power line DSL. In this case, the voltage Vss has a voltage value lower than a voltage (Vel+Vcath) that is sum of the threshold voltage Vel of the organic EL element 13 and a cathode voltage Vcath of the organic EL element 13. The voltage Vcc has a voltage value equal to or larger than the voltage (Vel+Vcath).

(Operation)

Next, the operation (the operation from light extinction to light emission) of the display unit 1 according to the present embodiment is described. In the present embodiment, compensating operation to variation of I-V characteristics of the organic EL element 13 is incorporated in order to maintain constant light emission luminance of the organic EL element 13 without being affected from temporal change of the I-V characteristics of the organic EL element 13 even if such temporal change occurs. Further, in the present embodiment, compensating operation to variation of the threshold voltage and the mobility is incorporated in order to maintain constant light emission luminance of the organic EL element 13 without being affected from the temporal change of the threshold voltage and the mobility of the drive transistor Tr1 even if such temporal change Occurs.

Figure 7:
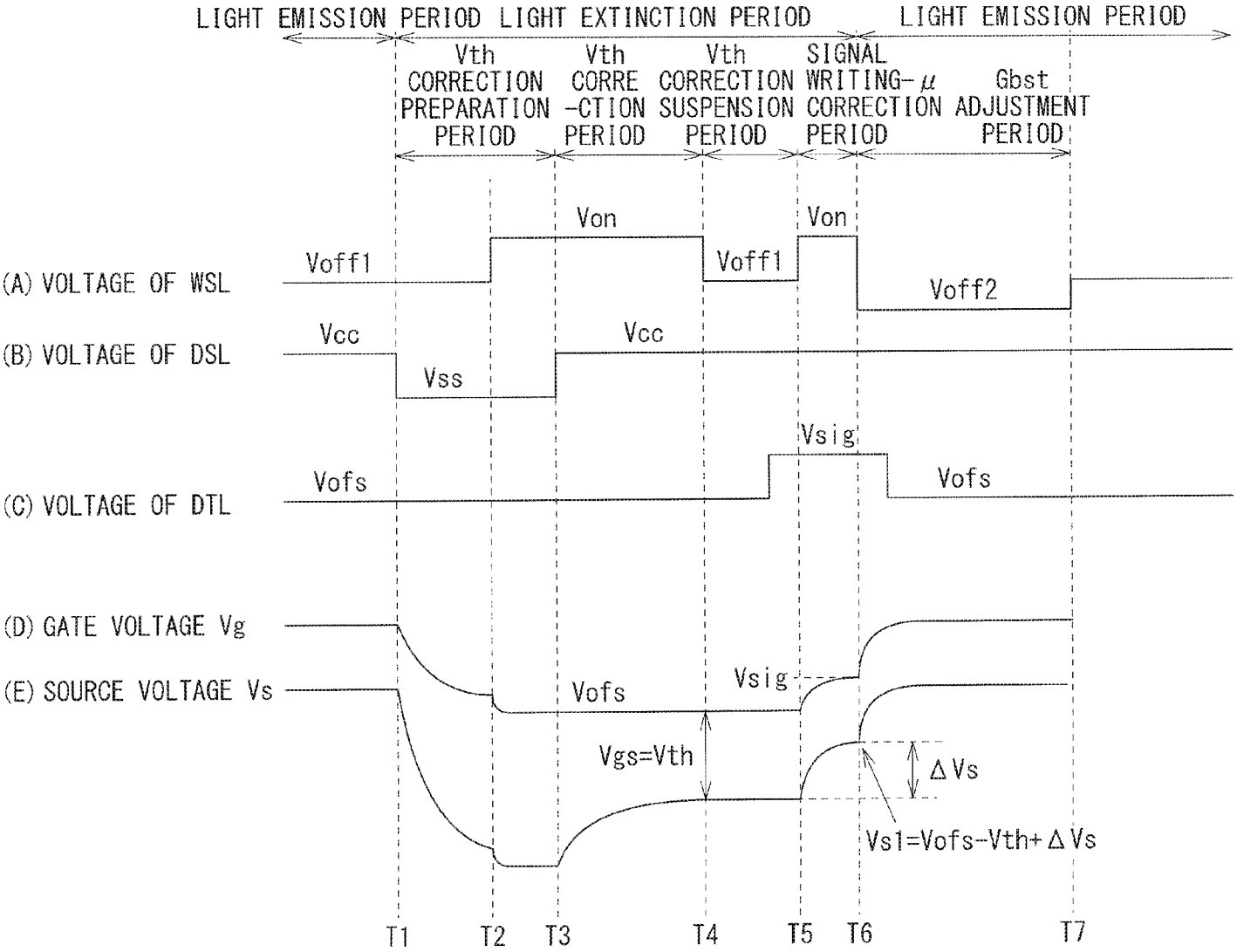

FIG. 7 illustrates an example of temporal change of the voltages applied to the scan line WSL, the power line DSL, and the signal line DTL, the gate voltage Vg, and the source voltage Vs when one pixel 11 is focused on.

(Vth Correction Preparation Period)

First, the drive circuit 20 performs preparation of the Vth correction that makes the gate-source voltage Vgs of the drive transistor Tr1 close to the threshold voltage of the drive transistor Tr1. Specifically, when the voltage of the scan line WSL is Voff1, the voltage of the signal line DTL is Vofs, and the voltage of the power line DSL is Vcc, the power line drive circuit 25 lowers the voltage of the power line DSL from Vcc to Vss in response to the control signal 21A (at a time T1). In other words, when the organic EL element 13 emits light, the power line drive circuit 25 lowers the voltage of the power line DSL from Vcc to Vss in response to the control signal 21A. Then, the source voltage Vs is decreased to Vss, and the organic EL element stops to emit light. At this time, the gate voltage Vg is also decreased by coupling through the retention capacitance Cs.

Next, while the voltage of the power line DSL is Vss and the voltage of the signal line DTL is Vofs, the scan line drive circuit 24 raises the voltage of the scan line WSL from Voff1 to Von in response to the control signal 21A (at a time T2). Then, the gate voltage Vg is decreased to Vofs. At this time, a potential difference between the gate voltage Vg and the source voltage Vs (the gate-source voltage Vgs) may be smaller than the threshold voltage of the drive transistor Tr1, or may be equal to or larger than the threshold voltage of the drive transistor Tr1.

(Vth Correction Period)

Next, the drive circuit 20 performs the Vth correction. Specifically, while the voltage of the signal line DTL is Vofs and the voltage of the scan line WSL is Von, the power line drive circuit 25 raises the voltage of the power line DSL from Vss to Vcc in response to the control signal 21A (at a time T3). Then, a current Ids flows between the drain and the source of the drive transistor Tr1, which raises the source voltage Vs. At this time, when the source voltage Vs is lower than Vofs-Vth, the current Ids flows between the drain and the source of the drive transistor Tr1 until the drive transistor Tr1 is cut off. In other words, when the Vth correction is not completed, the current Ids flows between the drain and the source of the drive transistor Tr1 until the gate-source voltage Vgs becomes Vth. Accordingly, the gate voltage Vg becomes Vofs and the source voltage Vs rises. As a result, the retention capacitance Cs is charged to Vth, and the gate-source voltage Vgs becomes Vth.

After that, the scan lien drive circuit 24 lowers the voltage of the scan line WSL from Von to Voff1 in response to the control signal 21A (at a time T4) before the signal line drive circuit 23 switches the voltage of the signal line DTL from Vofs to Vsig in response to the control signal 21A. Then, the gate of the drive transistor Tr1 is put into a floating state. Therefore, the gate-source voltage Vgs is allowed to be maintained to Vth irrespective of the magnitude of the voltage of the signal line DTL. In this way, setting the gate-source voltage Vgs to Vth makes it possible to eliminate variation of the light emission luminance of the organic EL element 13 even when the threshold voltage Vth of the drive transistor Tr1 is varied for each pixel circuit 12.

(Vth Correction Suspension Period)

Then, during the Vth correction suspension period, the signal line drive circuit 23 switches the voltage of the signal line DTL from Vofs to Vsig.

(Signal Writing-μ Correction Period)

After the Vth correction suspension period is ended (namely, after the Vth correction is completed), the drive circuit 20 performs writing of the signal voltage based on the picture signal 20A, and performs the μ correction. Specifically, while the voltage of the signal line DTL is Vsig and the voltage of the power line DSL is Vcc, the scan line drive circuit 24 raises the voltage of the scan line WSL from Voff1 to Von in response to the control signal 21A (at a time T5). Then, the gate of the drive transistor Tr1 is connected to the signal line DTL, and the gate voltage Vg of the drive transistor Tr1 becomes the voltage of the signal line DTL (Vsig). At this time, the anode voltage of the organic EL element 13 is still lower than the threshold voltage Vel of the organic EL element 13 at this stage, and the organic EL element 13 is cut off. Therefore, the current Ids flows through the element capacitance Coled of the organic EL element 13 and the sub-capacitance Csub, and the element capacitance Coled and the sub-capacitance Csub are charged. As a result, the source voltage Vs rises by ΔVs, and the gate-source voltage Vgs eventually becomes Vsig+Vth−ΔVs. In this way, the μ correction is performed at the same time as the writing. Here, ΔVs becomes larger as the mobility μ of the drive transistor Tr1 is larger. Therefore, variation of the mobility μ for each pixel 11 is allowed to be eliminated by making the gate-source voltage Vgs small by ΔVs before light emission.

(Light Emission Period-Gbst adjustment period)

Next, the scan line drive circuit 24 lowers the voltage of the scan line WSL from Von to Voff2 in response to the control signal 21A (at a time T6). Then, the current Ids flows between the drain and the source of the drive transistor Tr1, which raises the source voltage Vs. As a result, a voltage equal to or larger than the threshold voltage Vel is applied to the organic EL element 13, and thus the organic EL element 13 emits light at a desired luminance.

At this time, the scan line drive circuit 24 applies the voltage Voff2 that has a negative value allowing the write transistor Tr2 to be turned off, to the gate of the write transistor Tr2, when the organic EL element 13 is allowed to emit light. Therefore, the gate voltage of the write transistor Tr2 is Voff2, which is a negative value lower than Voff1. The off capacitance of the write transistor Tr2 is low as illustrated in FIG. 6, as compared with the case where a voltage of 0 V or positive voltage is applied to the gate of the write transistor Tr2. Therefore, lowering of the bootstrap gain is suppressed, and the bootstrap gain becomes 100% or near 100%. Therefore, the organic EL element 13 emits light at a desired luminance.

Finally, the scan line drive circuit 24 changes the voltage applied to the gate of the write transistor Tr2 from Voff2 to Voff1 until the organic EL element 13 is allowed to stop to emit light. Note that the voltage applied to the gate of the write transistor Tr2 may be Voff2 until the Vth correction preparation period. However, during a period when the voltage applied to the gate of the write transistor Tr2 is still Voff2, the negative bias is continuously applied to the gate of the write transistor Tr2. Therefore, taking into consideration characteristic deterioration of the write transistor Tr2 and the like, the period during which the Voff2 is applied to the gate of the write transistor Tr2 may be preferably as short as possible.

(Effects)

Next, effects in the display unit 1 according to the present embodiment will be described.

As described above, the bootstrap gain may be lowered due to the parasitic capacitance of the transistor in the pixel circuit 12. The parasitic capacitance of the transistor in the pixel circuit 12 has the threshold voltage of the transistor as a parameter. Therefore, the bootstrap gain may be varied for each pixel 11 due to the variation of the threshold voltage of the transistor in the pixel circuit 12. In this case, the light emission luminance is varied for each pixel 11, which impairs uniformity.

On the other hand, in the present embodiment, the write transistor Tr2 has characteristics that the parasitic capacitance at a time when the write transistor Tr2 is turned off is decreased as the magnitude of the negative bias applied to the gate voltage is increased. Therefore, when the organic EL element 13 is allowed to emit light, the voltage Voff2 having the negative value allowing the write transistor Tr2 to be turned off is applied to the gate of the write transistor Tr2, which makes it possible to reduce the parasitic capacitance of the write transistor Tr2 at the time of the bootstrap. As a result, variation of the bootstrap gain for each pixel 11 is allowed to be reduced, which makes it possible to obtain high uniformity.

2. APPLICATION EXAMPLES

Hereinafter, application examples of the display unit 1 that is described in the above-described embodiment will be described. The display unit 1 according to the above-described embodiment is applicable to display units of electronic apparatuses in every field that display a picture signal externally input or a picture signal internally generated as an image or a picture, such as a television apparatus, a digital camera, a notebook personal computer, a mobile terminal device such as a mobile phone, and a video camera.

Application Example 1

Figure 8:
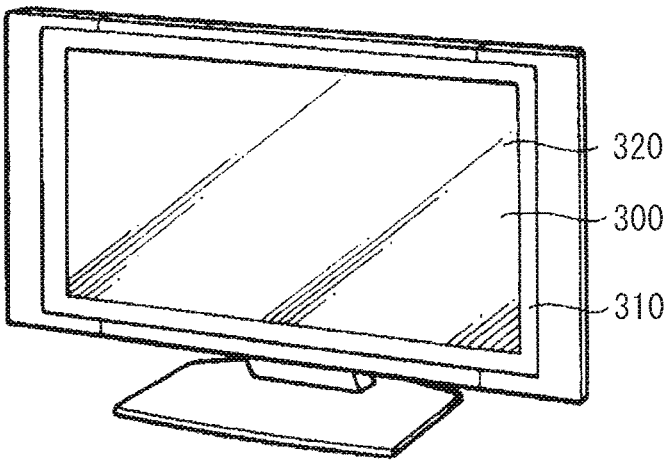
FIG. 8 is a perspective view illustrating an appearance of an application example 1 of the display unit according to the above-described embodiment.

FIG. 8 illustrates an appearance of a television apparatus to which the display unit 1 according to the above-described embodiment is applied. For example, the television apparatus may have a picture display screen section 300 that includes a front panel 310 and a filter glass 320, and the picture display screen section 300 is configured of the display unit 1 according to the above-described embodiment.

Application Example 2

Figure 9A:
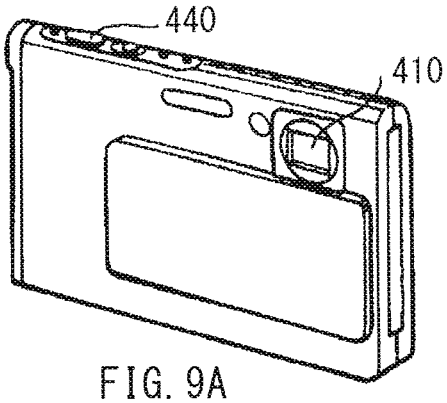
FIG. 9A is a perspective view illustrating an appearance of an application example 2 as viewed from a front side thereof.
Figure 9B:
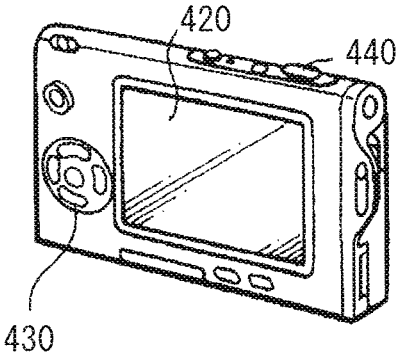
FIG. 9B is a perspective view illustrating the appearance of the application example 2 as viewed from a back side thereof.

FIG. 9A and FIG. 9B each illustrate an appearance of a digital camera to which the display unit 1 according to the above-described embodiment is applied. For example, the digital camera may include a light emitting section 410 for flash, a display section 420, a menu switch 430, and a shutter button 440. The display section 420 is configured of the display unit 1 according to the above-described embodiment.

Application Example 3

Figure 10:
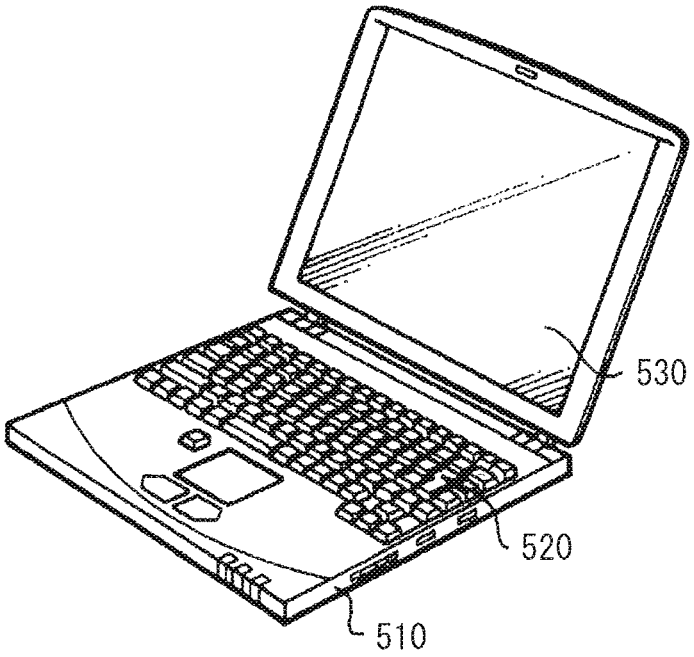
FIG. 10 is a perspective view illustrating an appearance of an application example 3.

FIG. 10 illustrates an appearance of a notebook personal computer to which the display unit 1 according to the above-described embodiment is applied. For example, the notebook personal computer may have a main body 510, a keyboard 520 for input operation of characters and the like, and a display section 530 configured to display an image. The display section 530 is configured of the display unit 1 according to the above-described embodiment.

Application Example 4

Figure 11:
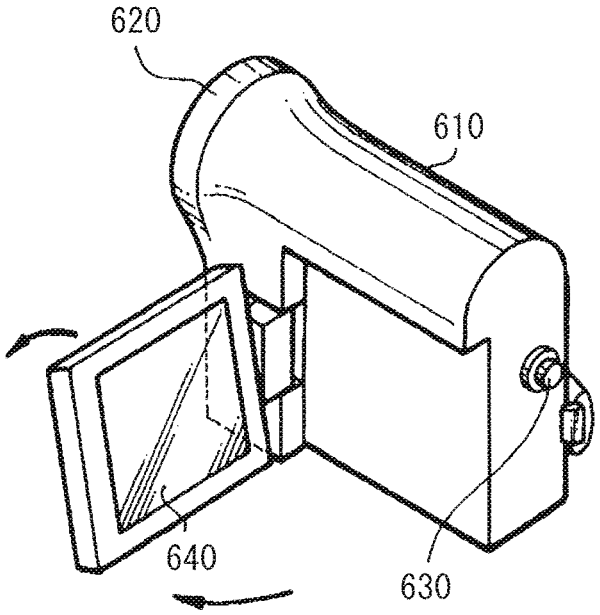
FIG. 11 is a perspective view illustrating an appearance of an application example 4.

FIG. 11 illustrates an appearance of a video camera to which the display unit 1 according to the above-described embodiment is applied. For example, the video camera may include a main body section 610, a lens 620 that is provided on a front side surface of the main body section 610 and is used to shoot an object, a shooting start-stop switch 630, and a display section 640. The display section 640 is configured of the display unit 1 according to the above-described embodiment.

Application Example 5

Figure 12A:
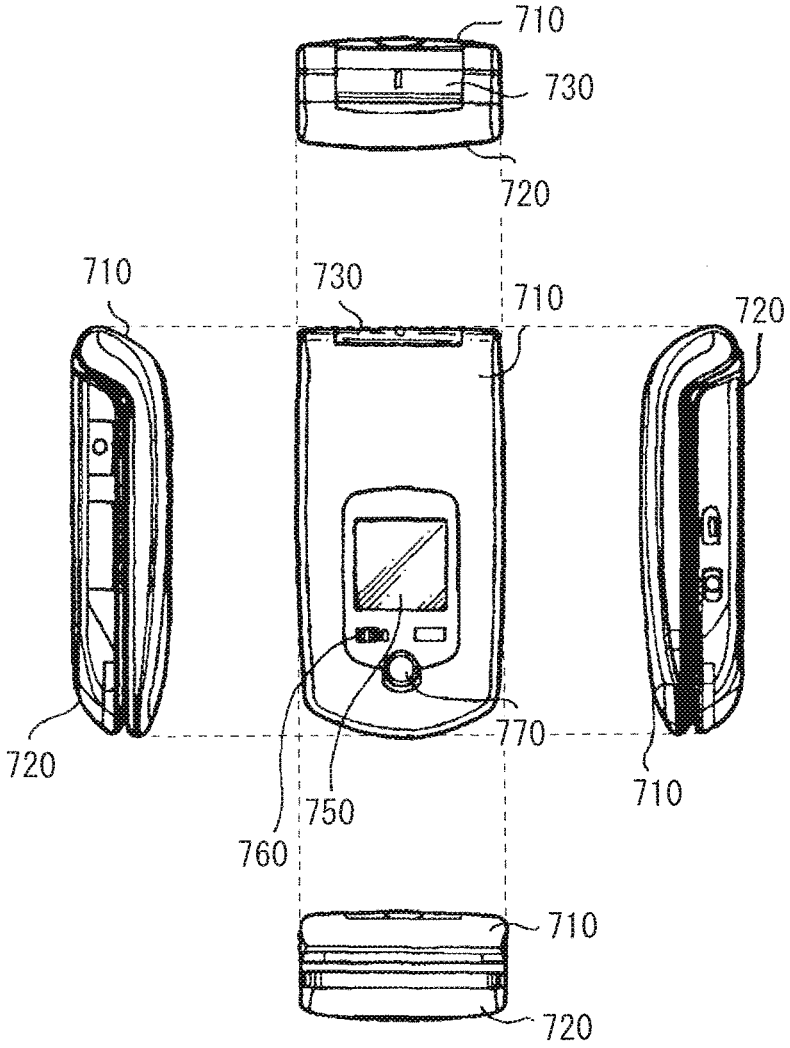
FIG. 12A is a front view, a left-side view, a right-side view, a top view, and a bottom view of an application example 5 in a closed state.
Figure 12B:
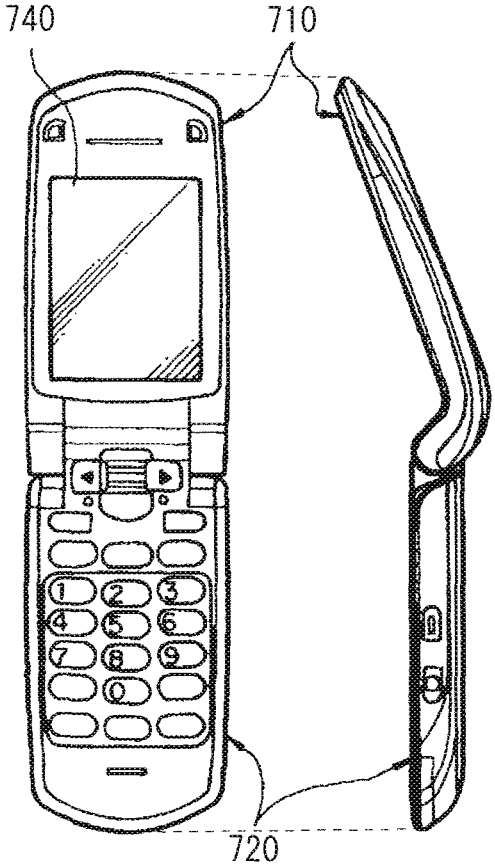
FIG. 12B is a front view and a side view of the application example 5 in an open state.

FIG. 12A and FIG. 12B each illustrate an appearance of a mobile phone to which the display unit 1 according to the above-described embodiment is applied. For example, the mobile phone may be configured by connecting an upper housing 710 and a lower housing 720 with a connection section (a hinge section) 730, and may include a display 740, a sub-display 750, a picture light 760, and a camera 770. The display 740 or the sub-display 750 is configured of the display unit 1 according to the above-described embodiment.

Hereinbefore, although the technology has been described with referring to the embodiment and the application examples, the technology is not limited to the above-described embodiment and the like, and various modifications may be made.

For example, the configuration of the pixel circuit 12 for the active matrix driving is not limited to that described in the above-described embodiment, and a capacitor and a transistor may be added as necessary. In this case, necessary drive circuits may be added based on modification of the pixel circuit 12, in addition to the signal line drive circuit 23, the scan line drive circuit 24, the power line drive circuit 25, and the like described above.

Moreover, in the above-described embodiment and the like, the driving of the signal line drive circuit 23, the scan line drive circuit 24, and the power line drive circuit 25 are controlled by the timing generation circuit 21 and the picture signal processing circuit 22. However, other circuits may control the driving. Moreover, the control of the signal line drive circuit 23, the scan line drive circuit 24, and the power line drive circuit 25 may be performed by hardware (circuits) or software (programs).

Furthermore, in the above-described embodiment and the like, the source and the drain of the write transistor Tr2 and the source and the drain of the drive transistor Tr1 are assumed to be fixed in the description. However, opposed relation between the source and the drain is inverted from the above-described description depending on the flowing direction of the current. In such a case, the source may be read as the drain and the drain may be read as the source in the above-described embodiment and the like.

Moreover, in the above-described embodiment and the like, each of the write transistor Tr2 and the drive transistor Tr1 is assumed to be formed of an n-channel MOS TFT in the description. However, one or both of the write transistor Tr2 and the drive transistor Tr1 may be formed of a p-channel MOS TFT. Incidentally, in the case where the drive transistor Tr1 is formed of a p-channel MOS TFT, the anode of the organic EL element 13 becomes the cathode and the cathode of the organic EL element 13 becomes the anode in the above-described embodiment and the like.

Moreover, for example, the present technology may be configured as follows.

(1) A display unit provided with a display panel including a light emitting element and a pixel circuit for each pixel, and a drive circuit configured to drive each of the pixels, the pixel circuit including:

a first transistor configured to sample a voltage corresponding to a picture signal, the first transistor having characteristics that a parasitic capacitance at a time when the first transistor is turned off is decreased as magnitude of negative bias applied to a gate voltage is increased;

a second transistor configured to control a current flowing through the light emitting element based on magnitude of the voltage sampled by the first transistor; and a retention capacitance configured to retain the voltage sampled by the first transistor.

(2) The display unit according to (1), wherein the drive circuit applies a first voltage to a gate of the first transistor when the light emitting element is allowed to emit light, the first voltage having a negative value allowing the first transistor to be turned off.

(3) The display unit according to (2), wherein the first voltage is lower than a second voltage, the second voltage being applied to the gate of the first transistor to turn off the first transistor during non-light emission of the light emitting element.

(4) The display unit according to any one of (1) to (3), wherein the drive circuit changes a voltage applied to the gate of the first transistor from the first voltage to a third voltage until the light emitting element is allowed to be turned off, the third voltage being higher than the first voltage.

(5) The display unit according to any one of (1) to (4), wherein the first transistor is a top-gate type transistor including an oxide semiconductor layer.

(6) The display unit according to (5), wherein the first transistor has the gate at a position facing the oxide semiconductor layer, and a low-resistance source region and a low-resistance drain region that are formed in the oxide semiconductor layer by treating the oxide semiconductor layer with use of the gate as a mask.

(7) An electronic apparatus provided with a display unit, the display unit including a display panel that includes a light emitting element and a pixel circuit for each pixel, and a drive circuit configured to drive each of the pixels, the pixel circuit including:

a first transistor configured to sample a voltage corresponding to a picture signal, the first transistor having characteristics that a parasitic capacitance at a time when the first transistor is turned off is decreased as magnitude of negative bias applied to a gate voltage is increased;

a second transistor configured to control a current flowing through the light emitting element based on magnitude of the voltage sampled by the first transistor; and a retention capacitance configured to retain the voltage sampled by the first transistor.

It should be understood by those skilled in the art that various modifications, combinations, sub-combinations, and alterations may occur depending on design requirements and other factors insofar as they are within the scope of the appended claims or the equivalents thereof.

What is claimed is:

1. A display unit provided with a display panel including a light emitting element and a pixel circuit for each pixel, and a drive circuit configured to drive each of the pixels, the pixel circuit comprising:

a first transistor configured to sample a voltage corresponding to a picture signal, the first transistor having characteristics that a parasitic capacitance at a time when the first transistor is turned off is decreased as magnitude of negative bias applied to a gate voltage is increased;

a second transistor configured to control a current flowing through the light emitting element based on magnitude of the voltage sampled by the first transistor; and a retention capacitance configured to retain the voltage sampled by the first transistor.

2. The display unit according to claim 1, wherein the drive circuit applies a first voltage to a gate of the first transistor when the light emitting element is allowed to emit light, the first voltage having a negative value allowing the first transistor to be turned off.

3. The display unit according to claim 2, wherein the first voltage is lower than a second voltage, the second voltage being applied to the gate of the first transistor to turn off the first transistor during non-light emission of the light emitting element.

4. The display unit according to claim 2, wherein the drive circuit changes a voltage applied to the gate of the first transistor from the first voltage to a third voltage until the light emitting element is allowed to be turned off, the third voltage being higher than the first voltage.

5. The display unit according to claim 2, wherein the first transistor is a top-gate type transistor including an oxide semiconductor layer.

6. The display unit according to claim 5, wherein the first transistor has the gate at a position facing the oxide semiconductor layer, and a low-resistance source region and a low-resistance drain region that are formed in the oxide semiconductor layer by treating the oxide semiconductor layer with use of the gate as a mask.

7. An electronic apparatus provided with a display unit, the display unit including a display panel that includes a light emitting element and a pixel circuit for each pixel, and a drive circuit configured to drive each of the pixels, the pixel circuit comprising:

a first transistor configured to sample a voltage corresponding to a picture signal, the first transistor having characteristics that a parasitic capacitance at a time when the first transistor is turned off is decreased as magnitude of negative bias applied to a gate voltage is increased;

a second transistor configured to control a current flowing through the light emitting element based on magnitude of the voltage sampled by the first transistor; and a retention capacitance configured to retain the voltage sampled by the first transistor.

* * * * *